US010188931B2

(12) United States Patent
Larson et al.

(10) Patent No.: US 10,188,931 B2
(45) Date of Patent: Jan. 29, 2019

(54) SMART BASEBALL FIRST BASE OR HOME PLATE

(71) Applicant: Intel Corporation, Santa Clara, CA (US)

(72) Inventors: Andrew Larson, Hillsboro, OR (US); Mark E. Sprenger, Tigard, OR (US); Ralph V. Miele, Hillsboro, OR (US); Eric D. McAfee, Portland, OR (US); Mark MacDonald, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/201,358

(22) Filed: Jul. 1, 2016

(65) Prior Publication Data

US 2018/0001179 A1 Jan. 4, 2018

(51) Int. Cl.

| | |
|---|---|
| ***A63B 71/00*** | (2006.01) |
| ***A63B 69/00*** | (2006.01) |
| ***A63B 71/06*** | (2006.01) |
| ***A63B 63/00*** | (2006.01) |
| *A63B 24/00* | (2006.01) |

(Continued)

(52) U.S. Cl.

CPC ..... *A63B 71/0605* (2013.01); *A63B 63/004* (2013.01); *A63B 63/008* (2013.01); *A63B 69/0013* (2013.01); *A63B 71/0622* (2013.01); *A63B 2024/0028* (2013.01); *A63B 2071/0625* (2013.01); *A63B 2071/0666* (2013.01); *A63B 2102/14* (2015.10); *A63B 2102/18* (2015.10); *A63B 2102/182* (2015.10); *A63B 2207/02* (2013.01); *A63B 2220/40* (2013.01); *A63B 2220/62* (2013.01); *A63B 2220/801* (2013.01); *A63B 2220/806* (2013.01); *A63B 2220/89* (2013.01); *A63B 2225/20* (2013.01);

(Continued)

(58) Field of Classification Search

CPC ..... A63B 71/065; A63B 71/0622; A63B 69/0097; A63B 71/0045; A63B 71/0605; A63B 63/004; A63B 63/008; A63B 69/0013; A63B 2102/14; A63B 2102/18; A63B 2102/182; A63B 2024/0028; A63B 2071/0625; A63B 2071/0666; A63B 2207/02; A63B 2220/40; A63B 2220/62; A63B 2220/801; A63B 2220/806; A63B 2220/89; A63B 2225/20; A63B 2225/50; A63B 2243/0025; A63B 2243/007

USPC ..... 473/451, 452, 497–500

See application file for complete search history.

(56) References Cited

U.S. PATENT DOCUMENTS 1,066,773 A * 7/1913 Willis ..... A63B 71/0605 473/500

2,440,042 A * 4/1948 Friedman ..... A63B 69/0013 473/500

(Continued)

*Primary Examiner* — Mitra Aryanpour

(74) *Attorney, Agent, or Firm* — Spectrum IP Law Group LLC

(57) ABSTRACT

Briefly, in accordance with one or more embodiments, a smart base for a baseball system or a softball system comprises a sensor to detect a first time at which a runner has touched the smart base, a radio-frequency (RF) receiver to receive a signal from a smart baseball that indicates a second time at which the smart baseball was caught, timing circuitry to detect if the second time occurs before or after the first time; and indicator circuitry to indicate a force out if the second time occurs before the first time.

6 Claims, 9 Drawing Sheets

(51) Int. Cl.
*A63B 102/14* (2015.01)
*A63B 102/18* (2015.01)

(52) U.S. Cl.
CPC ..... *A63B 2225/50* (2013.01); *A63B 2243/007* (2013.01); *A63B 2243/0025* (2013.01)

(56) References Cited

U.S. PATENT DOCUMENTS 3,938,804 A * 2/1976 Willett ..... A63B 69/0013 473/499
4,577,868 A * 3/1986 Kiyonaga ..... A63B 69/3667 473/452
4,591,154 A * 5/1986 Santarone ..... A63B 69/0002 473/497
4,627,620 A * 12/1986 Yang ..... A63B 69/0053 273/375
5,069,450 A * 12/1991 Pyle ..... A63B 24/0021 473/415
5,401,016 A * 3/1995 Heglund ..... A63B 69/0002 473/455
5,833,549 A * 11/1998 Zur ..... A63B 69/0002 473/453
5,984,810 A * 11/1999 Frye ..... A63B 24/0021 473/422
6,616,556 B1 * 9/2003 Osmudsen ..... A61B 5/1036 473/497
7,270,616 B1 * 9/2007 Snyder ..... A63B 24/0021 473/453
2006/0148594 A1 * 7/2006 Saintoyant ..... A63B 69/3632 473/415
2006/0160663 A1 * 7/2006 Serritella ..... A63B 24/0021 482/14
2008/0305897 A1 * 12/2008 Hall ..... A63B 69/0013 473/501
2010/0234769 A1 * 9/2010 Poliac ..... A63B 24/0003 600/592
2010/0248853 A1 * 9/2010 Dellinger ..... A63B 24/0021 473/225

* cited by examiner

SMART BASEBALL FIRST BASE OR HOME PLATE

BACKGROUND

Having a smart/connected baseball base and home plate, accompanied with a smart baseball, can help solve two common problems in baseball and/or softball. One of the most controversial calls in baseball is the force out at first base. In the last couple years, the Major League Baseball (MLB) and some colleges have instituted video replay to help the umpire determine if the runner touched the base before the first baseman caught the ball. The problems with video replay are that it is time-consuming since the umpire has to go over and watch the replay on a screen, and is not practical for baseball stadiums that do not have video recording systems such as at high schools and most colleges. Having an inexpensive and faster solution to determine force-outs would be very valuable to casual leagues or clubs, little league, or high school leagues.

When playing casual baseball, it may be difficult to determine whether a pitch was a strike or ball. Most of the time the catcher or pitcher just guesses, which can often lead to contention. Having an automated, instantaneous solution to determine whether a pitched ball is a strike, defined as above the plate and between the batter's knees and mid-torso, or a ball, defined as outside that area, would be valuable to casual players.

DESCRIPTION OF THE DRAWING FIGURES

Claimed subject matter is particularly pointed out and distinctly claimed in the concluding portion of the specification. However, such subject matter may be understood by reference to the following detailed description when read with the accompanying drawings in which:

Figure 1:
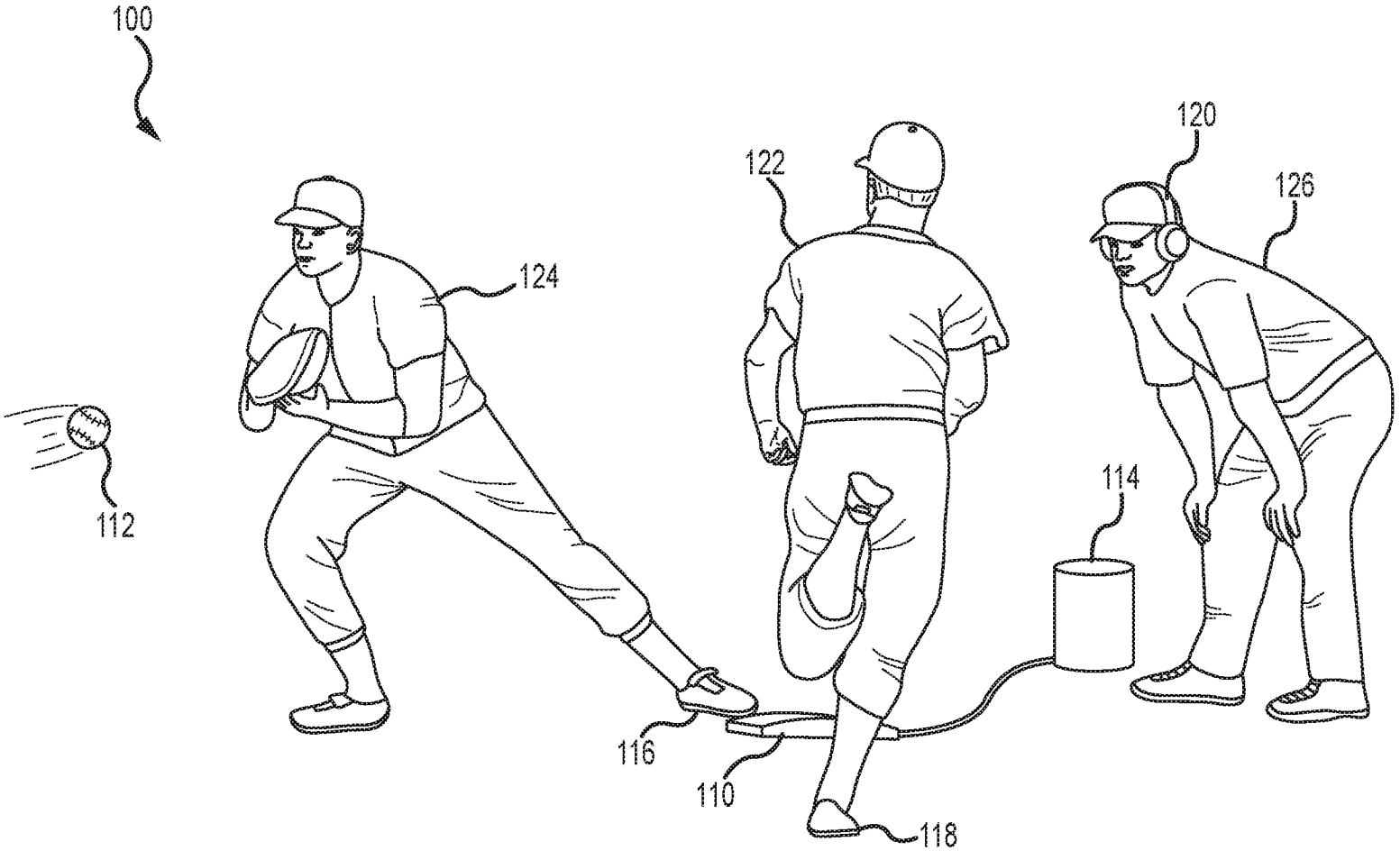
FIG. 1 is a diagram of a smart baseball system showing a smart base to determine a force out in accordance with one or more embodiments.

It will be appreciated that for simplicity and/or clarity of illustration, elements illustrated in the figures have not necessarily been drawn to scale. For example, the dimensions of some of the elements may be exaggerated relative to other elements for clarity. Further, if considered appropriate, reference numerals have been repeated among the figures to indicate corresponding and/or analogous elements.

DETAILED DESCRIPTION

In the following detailed description, numerous specific details are set forth to provide a thorough understanding of claimed subject matter. However, it will be understood by those skilled in the art that claimed subject matter may be practiced without these specific details. In other instances, well-known methods, procedures, components and/or circuits have not been described in detail.

In the following description and/or claims, the terms coupled and/or connected, along with their derivatives, may be used. In particular embodiments, connected may be used to indicate that two or more elements are in direct physical and/or electrical contact with each other. Coupled may mean that two or more elements are in direct physical and/or electrical contact. Coupled, however, may also mean that two or more elements may not be in direct contact with each other, but yet may still cooperate and/or interact with each other. For example, "coupled" may mean that two or more elements do not contact each other but are indirectly joined together via another element or intermediate elements. Finally, the terms "on," "overlying," and "over" may be used in the following description and claims. "On," "overlying," and "over" may be used to indicate that two or more elements are in direct physical contact with each other. "Over", however, may also mean that two or more elements are not in direct contact with each other. For example, "over" may mean that one element is above another element but not contact each other and may have another element or elements in between the two elements. Furthermore, the term "and/or" may mean "and", it may mean "or", it may mean "exclusive-or", it may mean "one", it may mean "some, but not all", it may mean "neither", and/or it may mean "both", although the scope of claimed subject matter is not limited in this respect. In the following description and/or claims, the terms "comprise" and "include," along with their derivatives, may be used and are intended as synonyms for each other.

Referring now to FIG. 1, a diagram of a smart baseball system showing a smart base to determine a force out in accordance with one or more embodiments will be discussed. It should be noted that smart baseball system 100 may include all of the components shown in FIG. 1 working together, or may include fewer or more components, for example to provide a subset or a superset of the features that are illustrated, and the scope of the claimed subject matter is not limited in this respect. Furthermore, although the game of baseball is used herein as an example, the principles of smart baseball system 100 and its constituent components also may be applicable to other sports similar to baseball such as softball, and/or to other sports such as football, soccer, or lacrosse, and some of many examples, and the scope of the claimed subject matter is not limited in this respect.

As shown in FIG. 1, a smart baseball system 100 may include a smart base 110 such as first base to be utilized in a baseball game to detect whether or not a player running to first base is forced out after successfully hitting the smart baseball 112 into the field of play. It should be noted that the term smart as used herein may refer to an item or device that may include one or more sensors and/or one or more circuitry to detect, measure, receive, transmit, and/or process information detected from one or more sensors, although the scope of the claimed subject matter is not limited in these respects. After hitting the smart baseball 112 into the field of play, player 122 attempts to run to smart base 110 and touch or tag smart base 110. If another player (not shown) throws the smart baseball 112 to player 124, for example first baseman, and player 124 is touching smart base 110 when the smart baseball 112 is caught prior to player 122 touching or tagging smart base 110, then a force out will occur. In accordance with one or more embodiments, smart base 110 may include one or more sensors to detect when player 122 has tagged smart base 110. Furthermore, smart baseball 112 may include one or more sensors to determine when player 124 has successfully caught the smart baseball 112, and may include a mechanism to transmit the timing information for the catch to the smart base 110. Circuitry in smart base 110 may compare the timing at which player tagged smart base 100 to the timing at which smart baseball 112 was caught by player 124 to determine whether or not a force out occurred, or whether player 110 was otherwise safe by tagging smart base 110 prior to the catch event.

In the event a force out occurs or if player 122 is safe, smart base 110 may include one or more indicators to indicate to the players and/or to umpire 126 if present, which event occurred. For example if a force out occurs, smart base 110 may indicate this event by illuminating or flashing first light or lamp of a first color, and/or may play an audible sound of a first tone or a first pattern. If player is safe, either no indication may occur wherein an indication occurs only if a force out occurs, or smart base 110 may indicate this event by illuminating or flashing a second light or lamp of a second color, and/or may play an audible sound of a second tone or a second pattern.

In some embodiments, smart base 110 may detect whether or not player 124 it touching smart base 110 at the time at which smart baseball is caught, for example by detecting the presence or pressure of the player's foot on smart base 110. In some embodiments, the shoe or cleat of player 124 may include a sensor or a transponder to assist with detecting whether or not player 124 is touching smart base 110 at the time at which smart baseball 112 is caught, and/or whether player 124 touches smart base 110 after catching smart baseball 112 and prior to player 122 tags smart base 110. Similarly, the shoe or cleat of player 122 may include a sensor or transponder to assist smart base 110 to detect the timing of when player 110 touches smart base 110.

In one or more embodiments, an auxiliary device such as a smart umpire 114 may be connected with smart base 110 that includes the indictors such as lights and/or speakers to make appropriate indications for smart base 110. Such a smart umpire 114 may be connected to smart base 110 via a wired connection or via a wireless connection. Furthermore, in some embodiments smart umpire 114 may include more advance circuitry to provide the ability to indicate the detected events using spoken words such as "Out!" or "Safe!". In addition, smart umpire 114 may include a user interface that is capable of detecting voice commands or the spoken input to control the functions of smart umpire 114 and/or smart base 110, and also may include circuitry to connect smart umpire 114 to a local area network or a wide area network. Such networking circuitry may allow smart umpire 114 to connect with other smart umpires or other smart bases such as second base and third base, and/or home plate, to work together for more control over the baseball game, to help record game statistics and scoring, and/or to provide software updates or the like.

In one or more embodiments, a human umpire 126 may be assisted with making a force out determination via an assist device 120 that may indicate to umpire 126 indication of a force out event or a safe event. For example, assist device 120 may comprise a headset that is may couple with smart base 110. Smart base 110 may transmit a signal to assist device 120 in response to a detected event, and the assist device 120 may play a sound in the ear of umpire 126 indicating to umpire which event occurred such a force out. If umpire 126 hears a tone or sound indicating a force out event, then umpire may signal or speak that an out has occurred. Assist device 120 may be a simple device such as a headset that produces sounds indicating the detected event, or more by a more advance device such as a hand held device, and/or may comprise an application running on a smart device such as a smart phone or smart band or watch, or headwear that includes a head up display (HUD), as some of many examples. Assist device 120 may have a similar architecture to the architecture of smart baseball 112 as discussed, below, or a subset thereof. These are merely example embodiments for assist device 120, and the scope of the claimed subject matter is not limited in these respects. Example architectures for the individual components are discussed below. An example architecture of smart base 110 is shown in and described with respect to FIG. 2, below.

Figure 2:
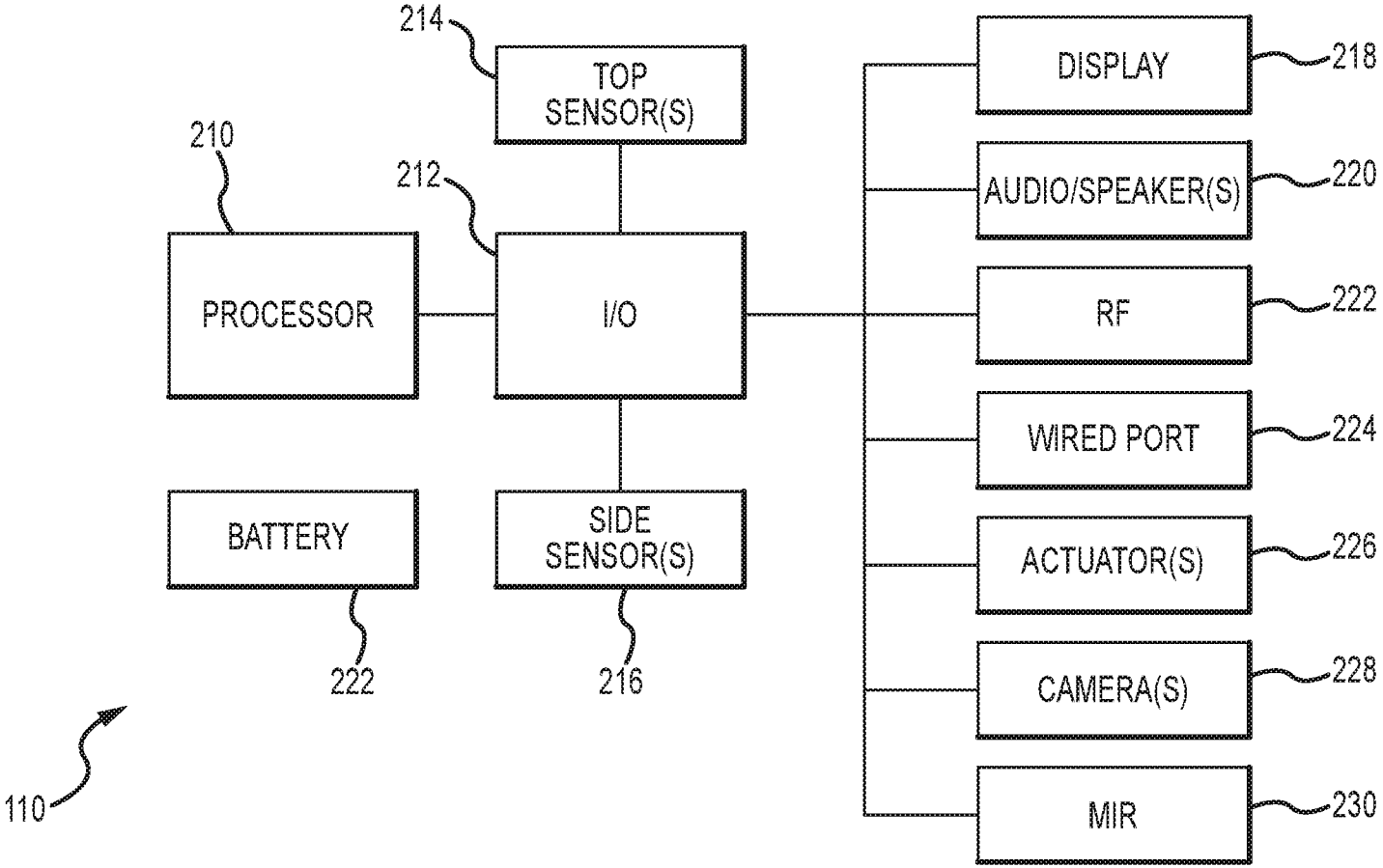
FIG. 2 is a diagram of an example architecture for a smart base in accordance with one or more embodiments.

Referring now to FIG. 2, a diagram of an example architecture for a smart base in accordance with one or more embodiments will be discussed. It should be noted that smart base 110 may include all of the components shown in FIG. 2, or may include fewer or more components, for example to provide a subset or a superset of the features that are illustrated, and the scope of the claimed subject matter is not limited in this respect. Smart base 110 may include a processor or logic circuitry 210, referred to herein as processor for purposes of discussion, to provide the control functions for smart base 110, for example to receive the inputs from various sensors and/or other external devices, and to make a timing decision regarding the events to determine if a force out or other event has occurred. Such sensors may include, for example, one or more top sensors 214 to detect if and/or when either player 122 or player 124 touches the top of smart base 110, and/or a one or more side sensors 216 to detect if and/or when player 124 touches a side of smart base 110 wherein the side of first base is a typical location to be touched by a first baseman during a force out event.

Input/output (I/O) circuitry 212 may provide a mechanism by which inputs from various sensors or communication circuitry is provided to processor 210, and/or to provide outputs such as control outputs or other signals to provide an indication of a determined event, and/or to send information regarding a determined event to an external device. Smart base 110 may include a display 218 to indicate an event wherein the display 218 may be a simple display such as lights or light emitting diodes (LEDs) that may be used to provide indications of a event, and/or as user interface to control the operation of smart base 110. In some embodiments, display 218 may be a more advance display such as an LED and/or an organic LED (OLED) panel, array, or strip. Audio circuitry 220 may include audio processing circuitry, audio amplifiers and/or one or more speakers, for example to provide audible indications of a determined event, and/or may be part of the user interface to control the operation of smart base 110. Radio-frequency (RF) circuitry may include wireless communication circuitry such as one or more Bluetooth™ radios, ZigBee radios, wireless local area network (WLAN) radios, wireless wide area network (WWAN) radios, personal area network (PAN) radios, one or more receives to detect wireless signals transmitted from other devices such as smart baseball 112 and/or sensor 116 and/or sensor 122 or the like. RF circuitry may operate in compliance with an Institute of Electrical Engineers (IEEE) standard such as the IEEE 802.15 standard and/or a Third Generation Partnership (3GPP) standard, or other wireless communication standards, the scope of the claimed subject matter is not limited in this respect. A wired port 224 may be used to couple with smart base 110, for example to couple smart base 110 with smart umpire 114. One or more actuators 226 may include buttons or switches to control the operation of smart base 110. Smart base 110 also may include a battery 222 to provide power for the components of smart base 110.

In some embodiments, smart base 110 may comprise a smart home plate such as shown in and described with respect to FIG. 6 or FIG. 7, below, in which case smart base 110 optionally may include one or more cameras 228 and/or one or more micropower impulse radar (MIR) devices 230, alternately referred to as a micropower ultra-wideband impulse radar (MUIR), although the scope of the claimed subject matter is not limited in these respects. In one or more embodiments, MIR devices 230 may utilize ultra-wideband (UWB) impulse sensors to emit and detect very low amplitude radar impulses and the reflections of those impulses. Such devices may include a short range or window in which objects passing through the window may be detected as the reflected radar impulses, for example by detecting a change in the return time of the reflected impulses. It should be noted that this is an example description of the operation of MIR devices 230, and the scope of the claimed subject matter is not limited in this respect. Information regarding a smart baseball 112 may be received via RF circuitry 222 for example, and/or smart baseball 112 may be detected via cameras 128 and/or MIR devices 230. An example diagram of a smart baseball is shown in and described with respect to FIG. 3, below.

Figure 3:
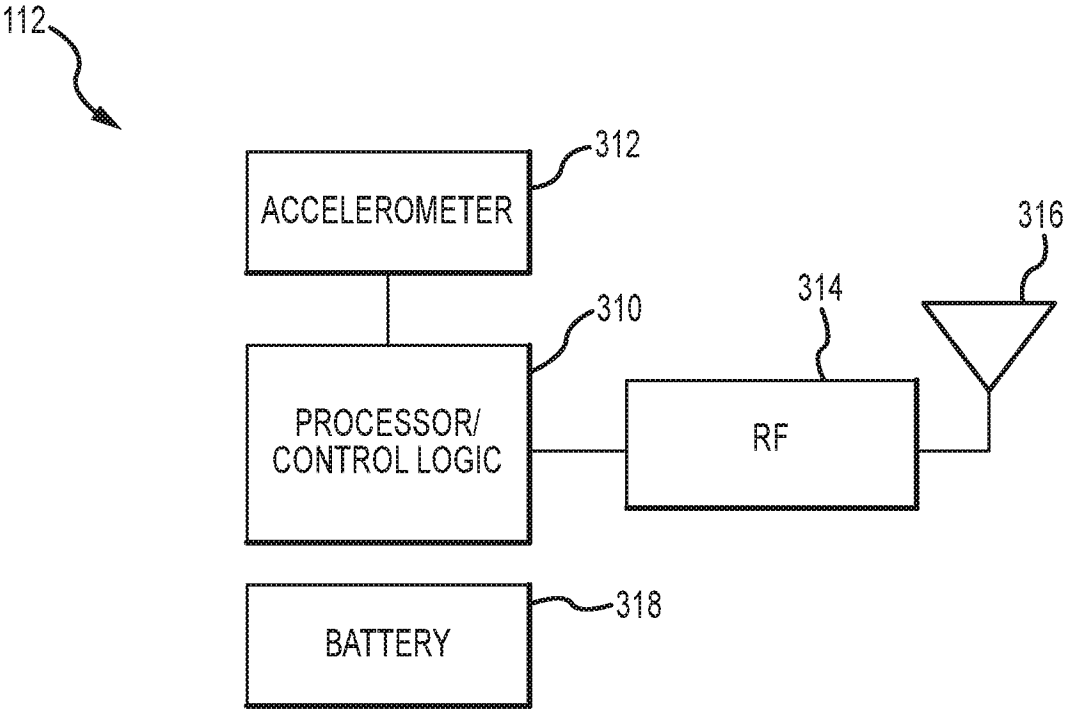
FIG. 3 is diagram of an example architecture of a smart baseball in accordance with one or more embodiments.

Referring now to FIG. 3, a diagram of an example architecture of a smart baseball in accordance with one or more embodiments will be discussed. It should be noted that smart baseball 112 may include all of the components shown in FIG. 3, or may include fewer or more components, for example to provide a subset or a superset of the features that are illustrated, and the scope of the claimed subject matter is not limited in this respect. As shown in FIG. 3, smart baseball 112 may may include a processor or logic circuitry 210, referred to herein as processor for purposes of discussion, to provide the control functions for smart baseball 112, for example to receive the inputs from one or more sensors such as accelerometer 312, and to provide one or more outputs to one or more other devices. Accelerometer 312 may be utilized to detect deceleration of smart baseball 312, for example to detect when smart baseball 112 is caught by player 124. In some embodiments, deceleration information detected by accelerometer 312 may be sent to smart plate 110 via RF circuitry 324 and one or more antennas 316, wherein the smart plate 110 analyzes the deceleration information to determine the timing at which smart baseball 112 has been caught. In other embodiments, processor 310 may analyze the deceleration information and determine the timing at which smart baseball 112 has been caught. In such embodiments, smart baseball 112 may transmit the timing information to smart base 110 which in turn compares the timing information of when smart baseball was caught to timing information of when player 122 has touched smart base 110 so that smart base 110 may make a force out determination. RF circuitry 314 may include circuitry similar to the circuitry of RF circuitry 222 of smart base 110, for example so that smart baseball 112 may communicate with smart base 110 using the same communication protocol, although the scope of the claimed subject matter is not limited in this respect. Smart baseball 112 may include a battery 318 to power the components of smart baseball 112. Smart baseball 112 may communicate with smart base 110 and/or may communicate with smart umpire 114. An example architecture for smart umpire 114 is shown in and described with respect to FIG. 4, below.

Figure 4:
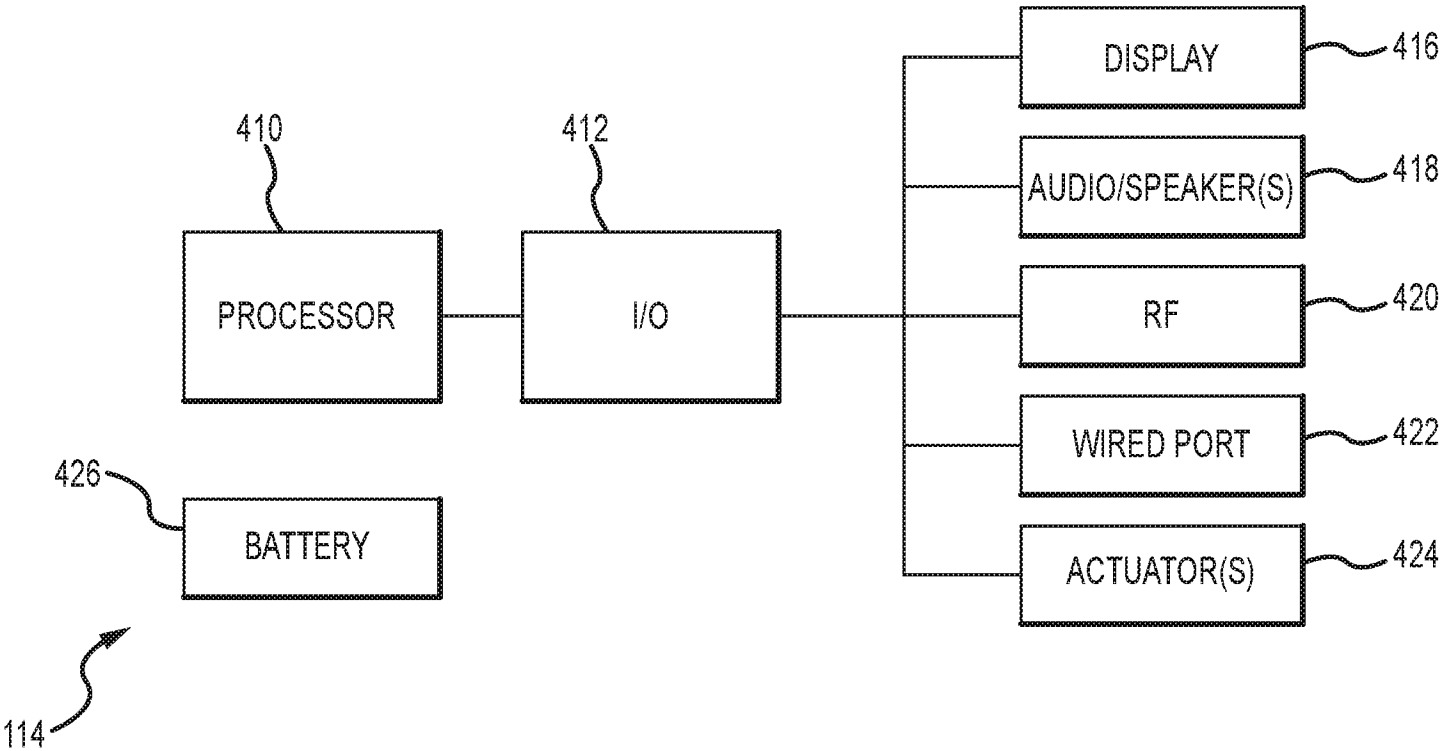
FIG. 4 is diagram an example architecture of a smart umpire accordance with one or more embodiments.

Referring now to FIG. 4, a diagram an example architecture of a smart umpire accordance with one or more embodiments will be discussed. It should be noted that smart umpire 114 may include all of the components shown in FIG. 4, or may include fewer or more components, for example to provide a subset or a superset of the features that are illustrated, and the scope of the claimed subject matter is not limited in this respect. As shown in FIG. 4, smart umpire 114 may include a processor or logic circuitry 410, referred to herein as processor for purposes of discussion, to provide the control functions for smart umpire 114. Processor 410 may couple to I/O circuitry 412 to receive and/or send information from and/or to the various devices. Smart umpire 114 may provide some or all of the functions of smart plate 110, and/or may work in conjunction with smart plate 110 to provide a more comprehensive system, and/or further may include additional functions that smart plate 110 may not provide.

In one or more embodiments, display 416 may be similar to display 218 of FIG. 2 and may include one or more lights or a display panel to control smart umpire 114, and/or to provide an indication of a detected event such as a force out or a safe runner. Audio circuitry 418, RF circuitry 420, wired port 422, and actuators 424, also may be similar to audio circuitry 220 and RF circuitry 222, wired port 224, and actuators 226 respectively, of smart base 110. Smart umpire 114 may couple with smart base 110 via wired port 422 and/or RF circuitry 420. In addition, smart umpire may include one or more microphones as part of audio circuitry 418, for example to receive voice commands or spoken input to control the operation of smart umpire 114. In such embodiments, the players or other operators may speak to and interact with smart umpire using natural language commands, and smart umpire may speak back to the users to provide feedback confirmation, status updates, to repeat the last call, and so on. RF circuitry 420 may communicate with smart baseball 112 and/or assist device 120 in addition to smart base 110, and may communicate via a network, for example to communicate with a remote information handling system to collect game statistics, and/or to display detected events on a larger display or scoreboard, although the scope of the claimed subject matter is not limited in these respects. Furthermore, smart umpire 114 may couple with multiple smart bases 110 such as first base, second base, and/or third base, and or optionally home plate. An example of a smart base 110 embodied as a home plate is shown in and described with respect to FIG. 5, below.

Figure 5:
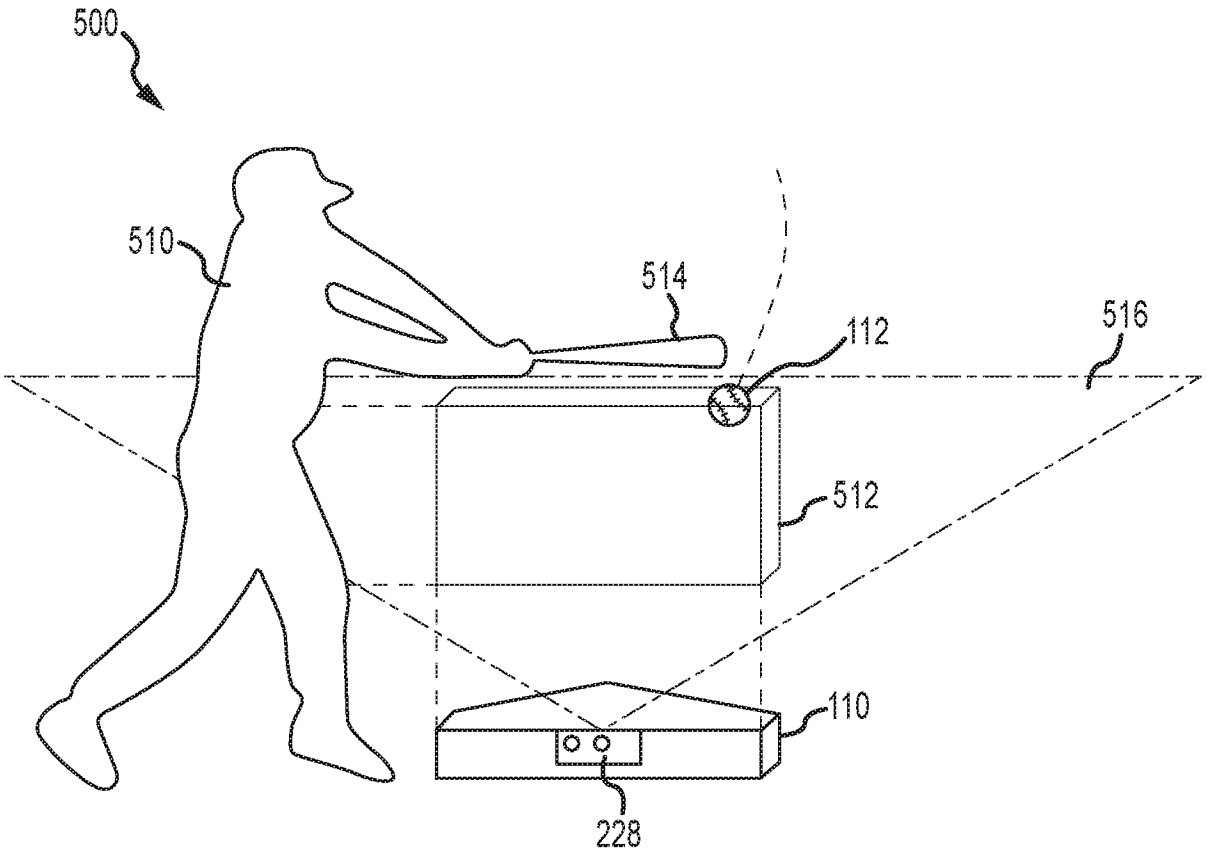
FIG. 5 is a diagram of an example smart home plate to detect a strike zone using a three-dimensional (3D) camera in accordance with one or more embodiments.

Referring now to FIG. 5, a diagram of an example smart home plate to detect a strike zone using a three-dimensional (3D) camera in accordance with one or more embodiments will be discussed. As shown in FIG. 5, strike zone system 500 includes a home plate as an embodiment of smart base 110. A strike zone 512 may be defined as a region bounded by the area of home plate and extending between the knees and mid-torso region of the batter 510. In the embodiment shown, the strike zone 512 may be detected by a three-dimensional (3D) camera 228 disposed in home plate. In one or more embodiments, 3D camera 228 may comprise a RealSense™ camera provided by Intel Corporation of Santa Clara, Calif., USA, although the scope of the claimed subject matter is not limited in this respect. The 3D camera 228 may have a field of view 516 covering the region in which strike zone 512 is located, and appropriate image processing may be performed by processor 210 of smart plate 110 to detect whether smart baseball 112 passes through strike zone 512 during a pitch, in which case a strike may be indicated and/or signaled by smart plate 110, smart umpire 114, or assist device 120, or whether smart baseball 112 passes outside of strike zone 512, in which case a ball may be indicated and/or signaled by smart plate, smart umpire 114, or assist device 120. In the event that smart baseball 110 passes through strike zone 512, a determination may be made whether or not the bat 514 comes in contact with smart baseball 110 when swung by batter 510. For example, accelerometer 312 may detect a change in acceleration of smart baseball 110 when smart baseball 110 comes in contact with bat 514, in which case a ball may be indicated and/or signaled instead of a strike. An alternative approach to detecting strike zone 512 is shown in and described with respect to FIG. 6, below.

Figure 6:
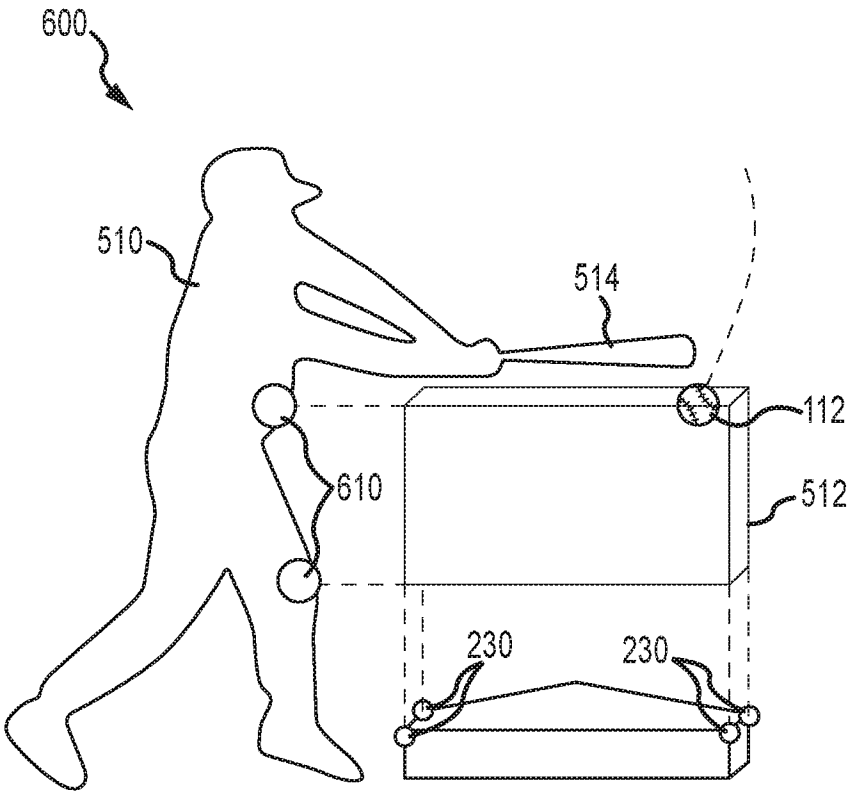
FIG. 6 is a diagram of an example smart home plate to detect a strike zone using impulse radar sensors in accordance with one or more embodiments.

Referring now to FIG. 6, a diagram of an example smart home plate to detect a strike zone using impulse radar sensors in accordance with one or more embodiments will be discussed. It should be noted that the strike zone system 600 of FIG. 6 is substantially similar to the strike zone system 500 of FIG. 5 except that strike zone system 600 utilizes a micropower impulse radar (MIR) system comprising one or more MIR devices 230 to detect strike zone 512. In such an embodiment, the batter 510 may wear reflectors 610 on his or her clothing, for example on the knees and on the mid-torso, to provide radar reflectivity to MIR sensors 230 to assist with detection of the boundaries of strike zone 512. Various other types of systems to detect strike zone 512 may be similarly deployed, for example using infrared sensors and infrared reflectors, and the scope of the claimed subject matter is not limited in this respect. An example application of strike zone system 500 and/or strike zone system 600 using a home plate as a smart base 110 is shown in and described with respect to FIG. 7, below.

Figure 7:
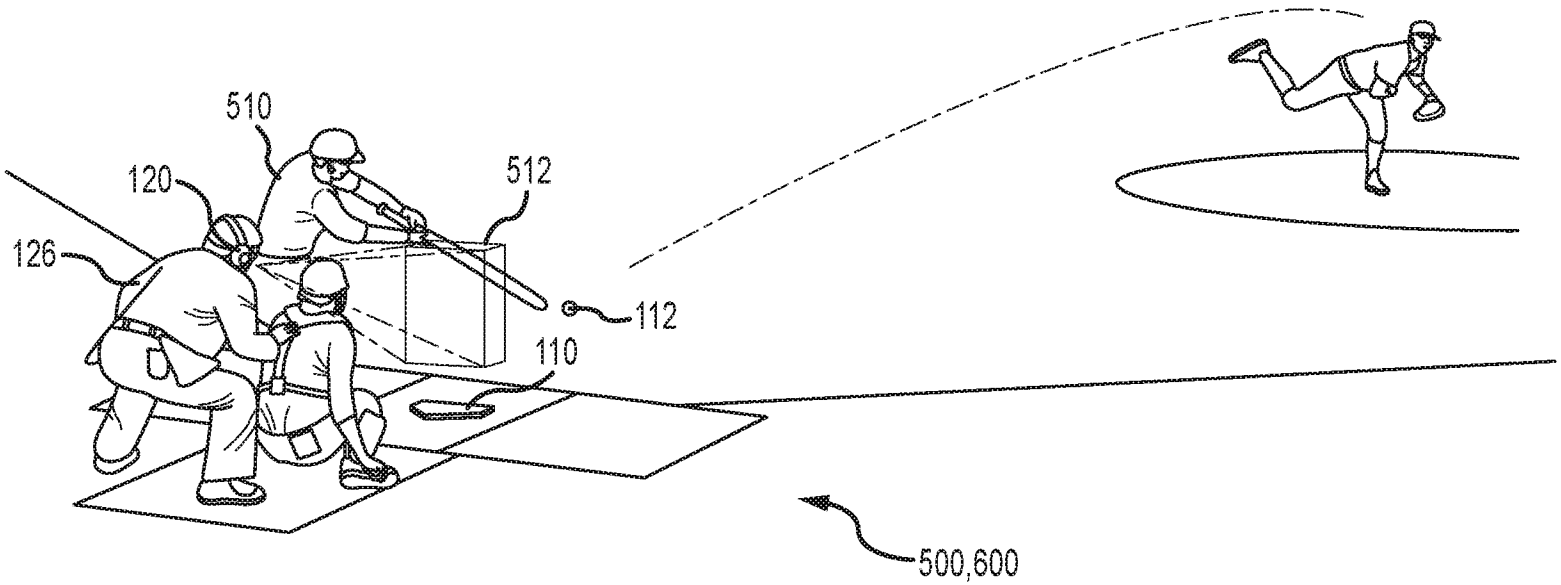
FIG. 7 is a diagram of an example home plate to detect a strike zone wherein the strike zone is electronically visualized for an umpire in accordance with one or more embodiments.

Referring now to FIG. 7, a diagram of an example home plate to detect a strike zone wherein the strike zone is electronically visualized for an umpire in accordance with one or more embodiments will be discussed. FIG. 7 shows an example of how strike zone system 500 and/or strike zone system 600 may be deployed in a baseball game. When smart baseball 110 is pitched to batter 510, strike zone system 500 and/or strike zone system 600 may detect a strike zone 512 for batter 510. Smart base 110 embodied as a home plate may generate image data to graphically represent the strike zone 512. Smart plate 110 may then transmit the image data representing strike zone 512 to assist device 120 worn by umpire 126. In the embodiment shown in FIG. 7, assist device 120 may comprise glasses, goggles, lenses, or in general a headset that includes a head up display (HUD) or similar display. The umpire 126 may see the graphical representation of strike zone 512 wherein the image of strike zone 512 may appear overlaid in the appropriate visual space of umpire 126. Such a system, for example, may include a HoloLens™ system provided by Microsoft Corporation of Redmond, Wash., USA, for example to project strike zone 512 in an augmented realty field of view of umpire 126, although the scope of the claimed subject matter is not limited in this respect.

Figure 8:
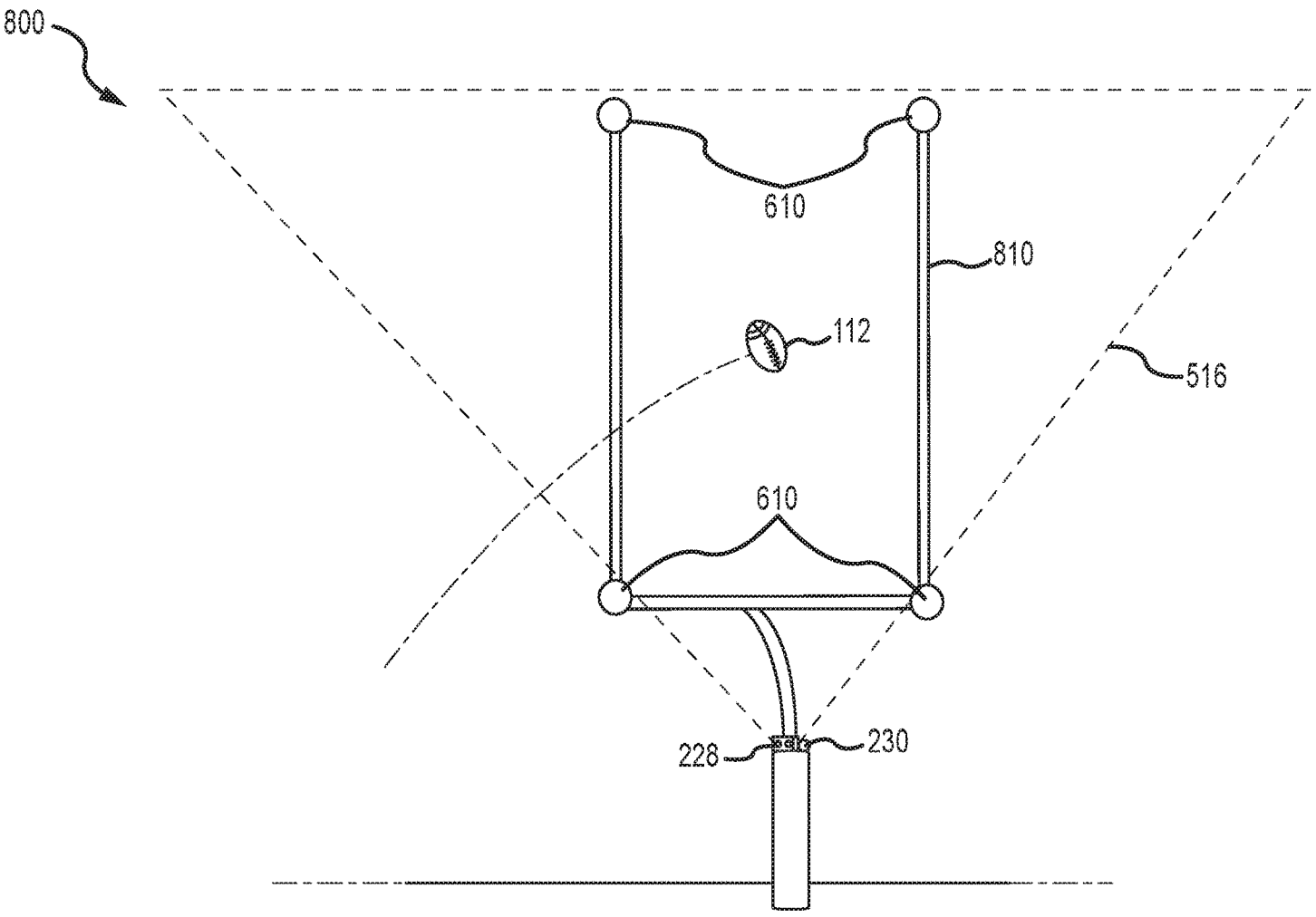
FIG. 8 is a diagram of an example smart sport system adapted for detecting a field goal in a football game in accordance with one or more embodiments.

Referring now to FIG. 8, a diagram of an example smart sport system adapted for detecting a field goal in a football game in accordance with one or more embodiments will be discussed. The field goal system 800 of FIG. 8 may be substantially similar to smart baseball system 100 of FIG. 1, with appropriate components selected and/or adapted to detect whether or not a smart baseball 112, embodied a smart football, passes through the field goal uprights 810. Such a field goal system 800 may include, for example 3D camera 228 to detect the uprights 810 in the field of view 516 of 3D camera 228, and/or may include one or more MIR detectors 230 with one or more reflectors 610 placed at the corners of the uprights 810.

Figure 9:
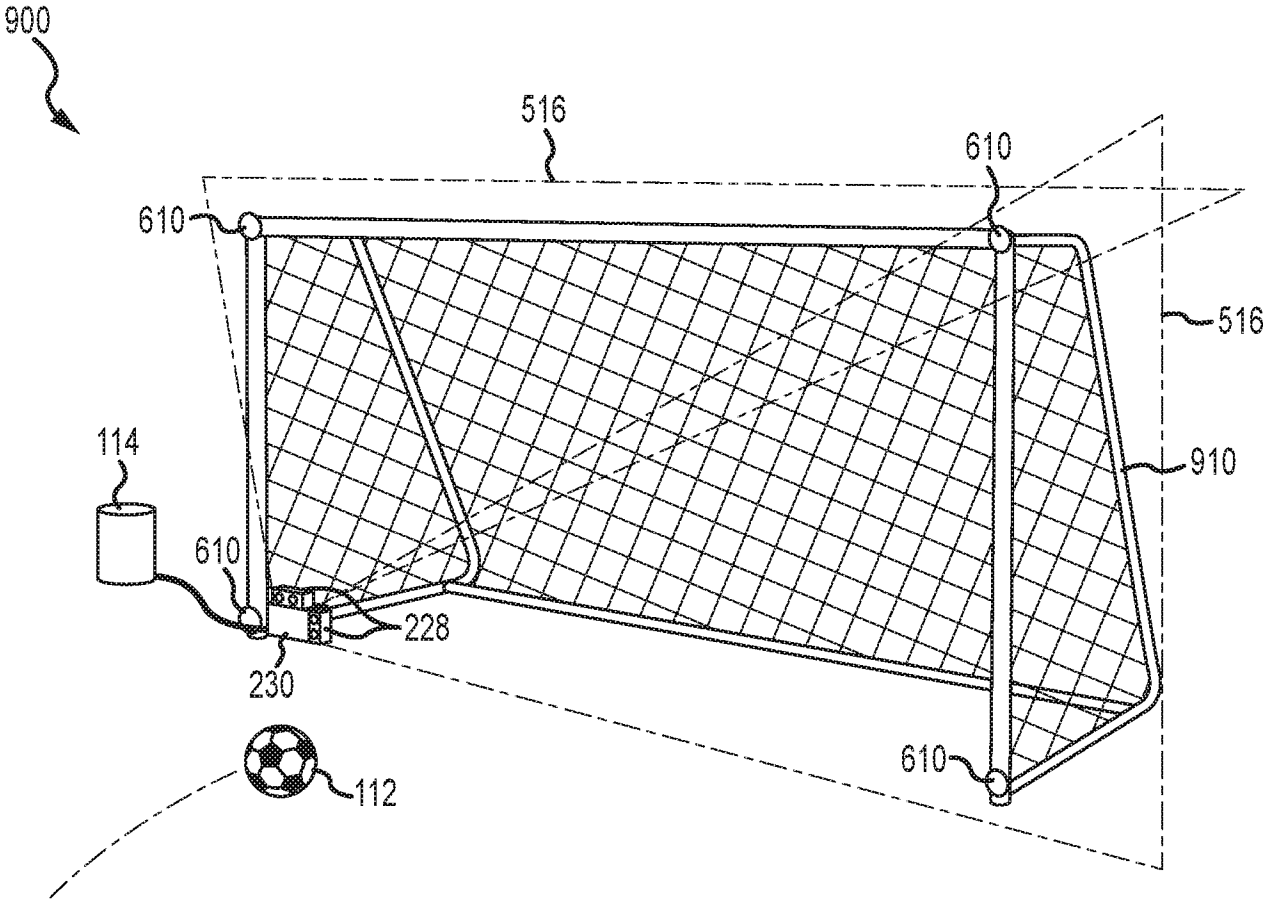
FIG. 9 is a diagram of an example smart sport system adapted for detecting a goal in a soccer game or a lacrosse game in accordance with one or more embodiments.

Referring now to FIG. 9, a diagram of an example smart sport system adapted for detecting a goal in a soccer game or a lacrosse game in accordance with one or more embodiments will be discussed. The smart goal system 900 of FIG. 9 may be substantially similar to smart baseball system 100 of FIG. 1, with appropriate components selected and/or adapted to detect whether or not a smart baseball 112, embodied as a smart soccer ball, entered into goal 910. Alternatively, smart baseball 112 may be embodied as a smart lacrosse ball, and goal 910 may comprise a lacrosse goal. Such a smart goal system 900 may include one or more 3D cameras 228 having respective fields of view 516 pointed to detect the front area of goal 910 to detect whether or not the soccer ball has entered the goal. Alternatively or in combination with 3D cameras 228, one or more MIR detectors 228 may operation in conjunction with one or more reflectors 610 placed on the corners of the goal 910 and/or at other positions on goal 910 to detect a goal event. Optionally, smart umpire 114 may be utilized to process the inputs from the devices of the smart goal system 900, and to indicate or otherwise signal whether or not a goal has been scored. It should be noted that although the sports of baseball, softball, football, soccer, and lacrosse have been mentioned as example sports, the systems described herein may be applied to various other sports such as basketball, volleyball, golf, cricket, tennis, and so on, and the scope of the claimed subject matter is not limited in this respect.

As used herein, the term "circuitry" may refer to, be part of, or include an Application Specific Integrated Circuit (ASIC), an electronic circuit, a processor (shared, dedicated, or group), and/or memory (shared, dedicated, or group) that execute one or more software or firmware programs, a combinational logic circuit, and/or other suitable hardware components that provide the described functionality. In some embodiments, the circuitry may be implemented in, or functions associated with the circuitry may be implemented by, one or more software or firmware modules. In some embodiments, circuitry may include logic, at least partially operable in hardware. Embodiments described herein may be implemented into a system using any suitably configured hardware and/or software.

Processor 210, processor 310, and/or processor 410 may include one or more application processors and/or application circuitry. For example, such processor and/or application circuitry may include circuitry such as, but not limited to, one or more single-core or multi-core processors. The one or more processors may include any combination of general-purpose processors and dedicated processors, for example graphics processors, application processors, and so on. The processors may be coupled with and/or may include memory and/or storage and may be configured to execute instructions stored in the memory and/or storage to enable various applications and/or operating systems to run on the system. The executions may be stored on one or more computer or machine readable media, which may comprise non-transitory media, to cause the processor and/or application circuitry to execute the instructions to result in the operation of the devices and/or systems described herein, although the scope of the claimed subject matter is not limited in these respects.

The following are example implementations of the subject matter described herein. It should be noted that any of the examples and the variations thereof described herein may be used in any permutation or combination of any other one or more examples or variations, although the scope of the claimed subject matter is not limited in these respects. In example one, a smart base for a baseball system or a softball system comprises a sensor to detect a first time at which a runner has touched the smart base, a radio-frequency (RF) receiver to receive a signal from a smart baseball that indicates a second time at which the smart baseball was caught, timing circuitry to detect if the second time occurs before or after the first time, and indicator circuitry to indicate a force out if the second time occurs before the first time. In example two, the smart base may include the subject matter of example one or any of the examples described herein, and further may comprise a side sensor disposed on a side of the smart base to detect if a baseman is touching the smart base at first time, wherein the indicator circuitry indicates a force out if the second time occurs before the first time, and the smart base detect that the baseman is touching the smart base at the first time. In example three, the smart base may include the subject matter of example one or any of the examples described herein, wherein the indictor circuitry includes a speaker to audibly indicate the force out occurrence, or to indicate a safe runner if the second time occurs after the first time. In example four, the smart base may include the subject matter of example one or any of the examples described herein, wherein the indictor circuitry includes a first light to indicate the force out occurrence, and second light to indicate a safe runner if the second time occurs after the first time. In example five, the smart base may include the subject matter of example one or any of the examples described herein, and further may comprise an RF transmitter to transmit an output of the indicator to a remote device, wherein the remote device comprises a smart umpire or an assist device, or a combination thereof. In example six, the smart base may include the subject matter of example one or any of the examples described herein, and further may comprise a port to connect to a remote device via a hard wire link.

In example seven, a smart baseball for a baseball system comprises an accelerometer to detect an acceleration of the smart baseball, processing circuitry to process a deceleration event based on the acceleration of the smart baseball, wherein the deceleration event indicates that the smart baseball has been caught, and radio-frequency (RF) circuitry to transmit information regarding the deceleration event to a remote device. In example eight, the smart baseball may include the subject matter of example seven or any of the examples described herein, wherein the processing circuitry is configured to analyze the acceleration of the smart baseball to determine the deceleration event. In example nine, the smart baseball may include the subject matter of example seven or any of the examples described herein, wherein the processing circuitry is configured to transmit the acceleration information relating to the deceleration event to a remote device that is capable determining the deceleration event based on the acceleration information.

In example ten, a smart home plate comprises sensor circuitry to sense a strike zone of a batter, processing circuitry to determine if a baseball has passed through the strike zone, and indicator circuitry to indicate a strike if the processing circuitry determines that the baseball has passed through the strike zone. In example eleven, the smart home plate may include the subject matter of example ten or any of the examples described herein, wherein the sensor circuitry comprises a three-dimensional (3D) camera to sense the strike zone in a field of view of the 3D camera. In example twelve, the smart home plate may include the subject matter of example ten or any of the examples described herein, wherein the sensor circuitry comprises a micropower impulse radar (MIR) to sense the strike zone via radar reflections. In example thirteen, the smart home plate may include the subject matter of example ten or any of the examples described herein, wherein the indictor circuitry includes a speaker to audibly indicate the strike, or to indicate a ball if the processing circuitry determines that the baseball has not passed through the strike zone. In example fourteen, the smart home plate may include the subject matter of example ten or any of the examples described herein, wherein the indictor circuitry includes a first light to indicate the strike, and second light to indicate a ball. In example fifteen, the smart home plate may include the subject matter of example ten or any of the examples described herein, and further may comprise an RF transmitter to transmit an output of the indicator circuitry to a remote device, wherein the remote device comprises a smart umpire or an assist device, or a combination thereof. In example sixteen, the smart home plate may include the subject matter of example ten or any of the examples described herein, and further may comprise a port to connect to a remote device via a hard wire link.

In example seventeen, a smart field goal system comprises sensor circuitry to sense an area in between uprights of a goal post, processing circuitry to determine if a football has passed through the uprights, and indicator circuitry to indicate a goal if the processing circuitry determines that the football has passed through the strike zone. In example eighteen, the smart field goal system may include the subject matter of example seventeen or any of the examples described herein, wherein the sensor circuitry comprises a three-dimensional (3D) camera to sense the area between the uprights. In example nineteen, the smart field goal system may include the subject matter of example seventeen or any of the examples described herein, wherein the sensor circuitry comprises a micropower impulse radar (MIR) to sense the area between the uprights via radar reflections. In example twenty, the smart field goal system may include the subject matter of example seventeen or any of the examples described herein, wherein the indictor circuitry includes a speaker to audibly indicate a successful goal, or to indicate a failed goal if the processing circuitry determines that the football has not passed through the uprights. In example twenty-one, the smart field goal system may include the subject matter of example seventeen or any of the examples described herein, wherein the indictor circuitry includes a first light to indicate the goal, and second light to indicate a failed goal. In example twenty-two the smart field goal system may include the subject matter of example seventeen or any of the examples described herein, and further may comprise an RF transmitter to transmit an output of the indicator circuitry to a remote device, wherein the remote device comprises a smart umpire or an assist device, or a combination thereof. In example twenty-three a smart goal system for soccer or lacrosse, comprises sensor circuitry to sense an area in front of a goal, processing circuitry to determine if a ball has passed through the area into the goal, and indicator circuitry to indicate a goal if the processing circuitry determines that the ball has passed through the area into the goal. In example twenty-four the smart goal system may include the subject matter of example twenty-three or any of the examples described herein, wherein the sensor circuitry comprises a three-dimensional (3D) camera to sense the area in front of the goal. In example twenty-five the smart field goal system may include the subject matter of example seventeen or any of the examples described herein, wherein the sensor circuitry comprises a micropower impulse radar (MIR) to sense the area in front of the goal via radar reflections. In example twenty-six the smart field goal system may include the subject matter of example seventeen or any of the examples described herein, wherein the indictor circuitry includes a speaker to audibly indicate a successful goal, or to indicate a failed goal if the processing circuitry determines that the ball has not passed through the uprights. In example twenty-seven the smart field goal system may include the subject matter of example seventeen or any of the examples described herein, wherein the indictor circuitry includes a first light to indicate the goal, and second light to indicate a failed goal. In example twenty-eight the smart field goal system may include the subject matter of example seventeen or any of the examples described herein, and further may comprise an RF transmitter to transmit an output of the indicator circuitry to a remote device, wherein the remote device comprises a smart umpire or an assist device, or a combination thereof. In example twenty-nine, machine-readable storage includes machine-readable instructions, when executed, to realize an apparatus as described in any preceding example. In example thirty, an apparatus comprises means to implement one or more functions described in any preceding example.

Although the claimed subject matter has been described with a certain degree of particularity, it should be recognized that elements thereof may be altered by persons skilled in the art without departing from the spirit and/or scope of claimed subject matter. It is believed that the subject matter pertaining a to smart baseball first base or home plate and many of its attendant utilities will be understood by the forgoing description, and it will be apparent that various changes may be made in the form, construction and/or arrangement of the components thereof without departing from the scope and/or spirit of the claimed subject matter or without sacrificing all of its material advantages, the form herein before described being merely an explanatory embodiment thereof, and/or further without providing substantial change thereto. It is the intention of the claims to encompass and/or include such changes.

What is claimed is:

1. A smart base for a baseball system or a softball system, comprising:

a sensor to detect a first time at which a runner has touched the smart base;

a radio-frequency (RF) receiver to receive a signal from a smart baseball that indicates a second time at which the smart baseball was caught;

timing circuitry to detect whether the second time occurs before or after the first time; and indicator circuitry to indicate a force out when the second time occurs before the first time.

2. The smart base as claimed in claim 1, further comprising a side sensor disposed on a side of the smart base to detect whether a baseman is touching the smart base at the first time, wherein the indicator circuitry indicates a force out when the second time occurs before the first time, and the smart base detects that the baseman is touching the smart base at the first time.

3. The smart base as claimed in claim 1, wherein the indictor circuitry includes a speaker to audibly indicate the force out occurrence, or to indicate a safe runner when the second time occurs after the first time.

4. The smart base as claimed in claim 1, wherein the indictor circuitry includes a first light to indicate the force out occurrence, and second light to indicate a safe runner when the second time occurs after the first time.

5. The smart base as claimed in claim 1, further comprising an RF transmitter to transmit an output of the indicator to a remote device, wherein the remote device comprises a smart umpire or an assist device, or a combination thereof.

6. The smart base as clamed in claim 1, further comprising a port to connect to a remote device via a hard wire link.

* * * * *